US006841726B2

(12) United States Patent
Steffens et al.

(10) Patent No.: US 6,841,726 B2
(45) Date of Patent: Jan. 11, 2005

(54) PAGE TURNING ARRANGMENT

(75) Inventors: Robert S. Steffens, Peapack, NJ (US); Ben Shepard, Parsippany, NJ (US)

(73) Assignee: Steffen Rosen LLC, Parsippany, NJ (US)

( * ) Notice: Subject to any disclaimer, the term of this patent is extended or adjusted under 35 U.S.C. 154(b) by 0 days.

(21) Appl. No.: 10/400,124

(22) Filed: Mar. 26, 2003

(65) Prior Publication Data

US 2004/0187669 A1 Sep. 30, 2004

(51) Int. Cl.[7] ..... G10G 7/00
(52) U.S. Cl. ..... 84/486; 84/489
(58) Field of Search ..... 84/486–497, 500

(56) References Cited

U.S. PATENT DOCUMENTS

| | | | | |
|---|---|---|---|---|
| 999,130 | A | | 4/1911 | Detweiler |
| 3,087,268 | A | | 4/1963 | Rice |
| 3,174,242 | A | | 3/1965 | Degorski et al. |
| 3,217,435 | A | | 11/1965 | Steiert |
| 3,229,344 | A | | 1/1966 | Renquist |
| 3,277,596 | A | | 10/1966 | Shachar |
| 3,281,974 | A | | 11/1966 | Jensen |
| 3,343,776 | A | | 9/1967 | Wieszeck |
| 3,371,571 | A | | 3/1968 | Barbera |
| 3,374,701 | A | | 3/1968 | Wallenberg |
| 3,475,844 | A | | 11/1969 | Shukichi Uda |
| 3,522,434 | A | | 8/1970 | Varson |
| 3,550,296 | A | | 12/1970 | Castagna |
| 3,570,154 | A | | 3/1971 | Cosenza |
| 3,664,629 | A | | 5/1972 | Reed |
| 3,665,093 | A | | 5/1972 | Machnacz |
| 3,732,773 | A | | 5/1973 | Bombardi |
| 4,040,195 | A | | 8/1977 | Claypool |
| 4,084,468 | A | | 4/1978 | Butler |
| 4,160,334 | A | | 7/1979 | Willis |
| 4,346,641 | A | | 8/1982 | Kobayashi |
| D269,683 | S | | 7/1983 | Barbour |
| 4,423,659 | A | | 1/1984 | Cassels-Brown |
| D275,402 | S | | 9/1984 | O'Brien |
| 4,644,675 | A | | 2/1987 | Berger |
| 4,719,712 | A | | 1/1988 | Moreau |
| 5,052,266 | A | | 10/1991 | Burster |
| 5,203,248 | A | | 4/1993 | Carr |
| 5,233,900 | A | | 8/1993 | Fitzgerald |
| 5,373,772 | A | | 12/1994 | Shemoul |
| 5,493,943 | A | * | 2/1996 | Horikawa ..... 84/519 |
| 5,640,252 | A | * | 6/1997 | Turner et al. ..... 358/497 |
| 5,962,801 | A | | 10/1999 | Bowman |

FOREIGN PATENT DOCUMENTS

| | | | |
|---|---|---|---|
| FR | 2757797 | * 12/1996 | ..... 84/519 |

* cited by examiner

*Primary Examiner*—Kimberly Lockett
(74) *Attorney, Agent, or Firm*—Kirschstein, et al..

(57) ABSTRACT

An arrangement for turning pages successively picks up each page by suction applied to a bottom corner thereof, and turns the page over a turning axis. A wireless actuator initiates the turning. The arrangement is mountable at diverse locations and is quiet in operation.

35 Claims, 6 Drawing Sheets

PAGE TURNING ARRANGMENT

BACKGROUND OF THE INVENTION

1. Field of the Invention

The present invention generally relates to an arrangement for controllably turning pages in a book and, more particularly, to a compact, portable and quiet unit for reliably turning pages, one at a time, in a hands-free manner.

2. Description of the Related Art

Many devices have been proposed in the art for turning the pages or leaves of a book, pamphlet, sheet music, magazine, newspaper and the like. Such devices are useful by musicians who need both hands to play their instruments, by persons permanently or temporarily suffering from a handicap affecting their arms, hands, or fingers, and by non-handicapped persons who simply wish, for work or leisure purposes, to periodically turn pages in order to read, consult or, in general, use them.

Such devices have used mechanical transmissions, including rotary cams, rotating cylinders, mobile skids, articulated arms, clamps and like linkages. Such devices have also included pivoted suction conduits for engaging and lifting pages by suction. However, as advantageous as these known devices have been, they are of complicated construction, noisy in operation, expensive to manufacture, difficult to maintain and irregular in operation.

SUMMARY OF THE INVENTION

OBJECTS OF THE INVENTION

Accordingly, one object of this invention is to provide a page turning arrangement which is efficient, regular and quiet in operation.

Another object of this invention is to provide a page turning arrangement that requires little maintenance and is inexpensive to manufacture.

Still another object of this invention is to provide a reliable, portable, quiet, convenient and adaptable page turning arrangement.

FEATURES OF THE INVENTION

In keeping with these objects and others which will become apparent hereinafter, one feature of this invention resides, briefly stated, in an arrangement for turning pages of a book, including a support for holding the book open. As used herein, the term "book" is intended to include a collection of pages, whether bound or unbound, whether blank, printed or manuscript, and incorporated as a booklet, pamphlet, sheet music, newspaper, magazine and like collection.

The arrangement includes a suction source, preferably a vacuum pump, including a nozzle, for generating a suction force at the nozzle in an energized state of the pump, and for discontinuing the suction force at the nozzle in a deenergized state of the pump. The arrangement further includes a drive, preferably including a reversible motor, for moving the nozzle between a pickup position and a release position. The drive and the source are under the control of a controller, preferably a microprocessor.

In the pickup position, the nozzle is positioned by the drive in an overlying relationship with an outer peripheral margin of the page and within a boundary of the page. Preferably, the outer margin is a corner of the page. The source is energized, and the nozzle engages a page to be turned by suction. After an adjustable time delay in accordance with one embodiment, the drive jointly moves the nozzle and the page in one circumferential direction about a turning axis along a turning path to the release position.

Alternatively, in conjunction with, or in lieu of, the adjustable time delay, a vacuum sensor is operative, in series with the vacuum source, for sensing that the nozzle has engaged the page. This avoids the possibility that the nozzle is moved without the page.

In the release position, the drive is halted, and the vacuum source is deenergized to release the page from the nozzle. A solenoid valve is activated to discontinue the suction and insure the total release of the page from the nozzle. A rear end of the nozzle in the release position affirmatively pushes any previous page that was turned toward the support. After another adjustable time delay, the drive returns the nozzle in an opposite circumferential direction about the turning axis along a return path to the pickup position. During the return movement, the nozzle partially bends the page at the outer margin. More particularly, the nozzle bends a lower corner of the page so as to bypass the page and leave the page at the release position.

An actuator is operatively connected to the drive and the vacuum source for initiating turning of the page. Preferably, the actuator is in wireless communication with the controller. The actuator includes a reader-operated switch, preferably actuated by the reader's foot, to initiate operation. Other actuators may include a blow switch, a finger-operated switch, or any motion-responsive switch that can control an electric circuit.

The drive and the source are contained in a housing in which a rechargeable battery pack is contained to constitute a self-contained unit to which the book support is connected. The batteries of the pack can be recharged by an external power supply, or the arrangement can be directly operated by an external power supply. A backup set of batteries may be included. A visual or auditory indicator may be used to alert a user to the current level or remaining level of electrical power remaining in the batteries. The unit is mountable on any generally planar support surface, or on a floor-mounted or table-mounted music stand.

A corner piece, preferably constituted of a nonporous plastic film, is adhered by a pressure sensitive adhesive to the page corner. The corner piece helps insure that only one page at a time is attracted to the nozzle in the pickup position, and that the released page is bypassed when the nozzle returns to the pickup position. The corner piece also helps to protect the page corner from wear due to repeated use.

It is preferred that the turning axis be aligned lengthwise with the spine or turning axis of the book. A visual indicator on the support helps insure the proper placement of the book thereon. The positioning of the nozzle at the page corner, preferably the lower corner, simulates the real-life page-turning action by a reader. In order to insure that the released page does not return with the nozzle, a pair of fibrous elements is mounted on the support, preferably on a bottom surface thereof, and has fibers that extend along the turning path and along the return path. These fibers frictionally engage bottom edges of the page and resist double sheets from being turned, and also prevent the released page from returning with the nozzle.

The arrangement is quiet in operation and is inaudible to a listener or the reader. An unlimited number of pages, one at a time, can be turned. The arrangement is portable and easily transportable from place to place. With slight adaptation, the pages can be turned from left to right.

The arrangement is operational with backup batteries, or an external power supply, even while rechargeable batteries are being charged. Although a wireless actuator is preferred, a wired actuator can be used, for example, if electronic interference is present. If multiple wireless actuators are employed, for example, in an orchestra, then each actuator can be assigned a separate frequency or channel.

A metronome for signaling a given tempo and/or a tuner for generating one or more tones at a given frequency may be included in the arrangement.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
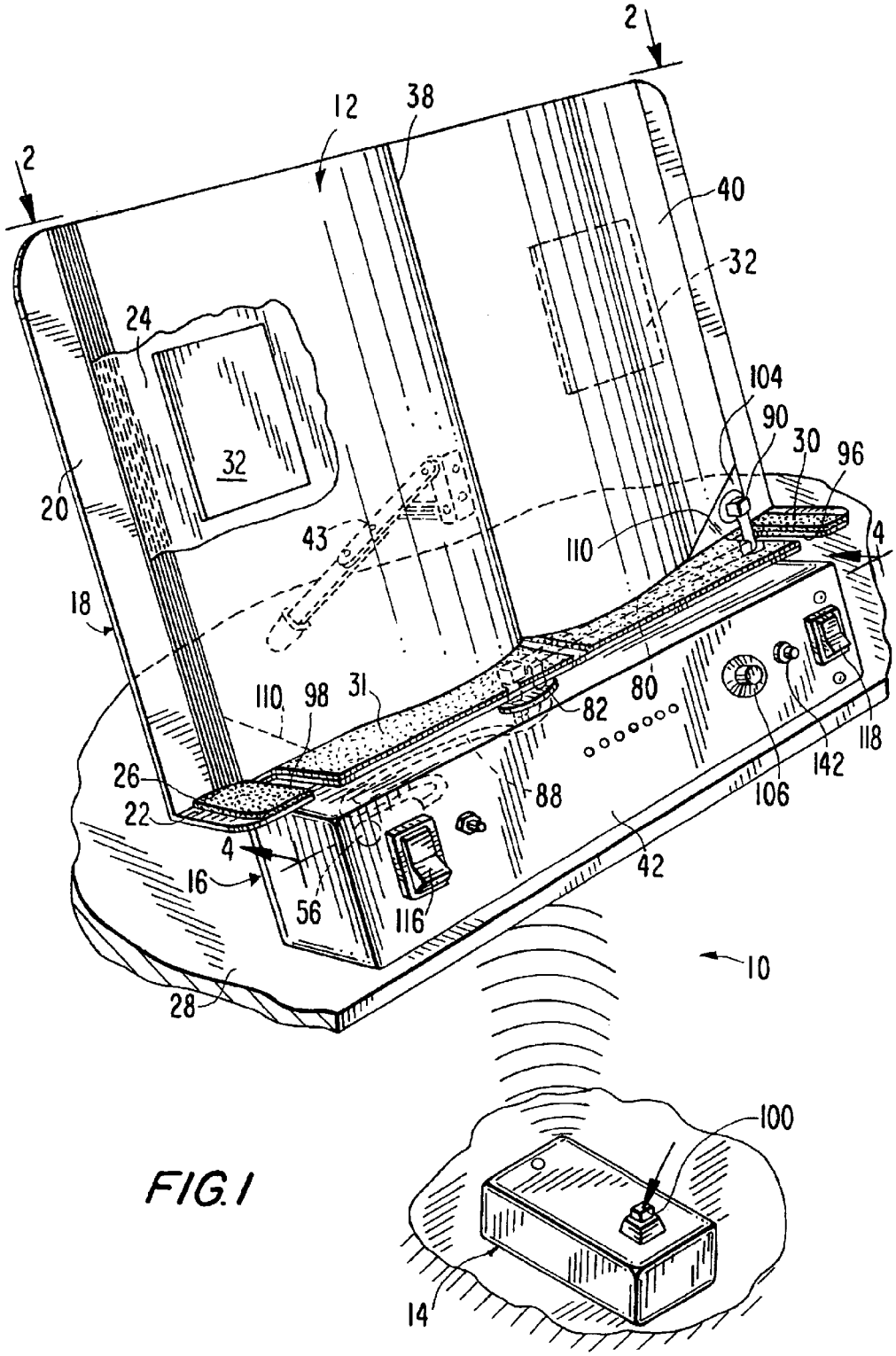
FIG. 1 is a perspective view of an arrangement for turning pages of a book according to this invention in one condition of use.

Reference numeral 10 in FIG. 1 generally depicts an arrangement for turning pages of a book 12 according to this invention. Arrangement 10 includes an actuator 14 for initiating the turning of a page, and a portable unit 16 on which the book 12 is supported. As used herein, the term "book" includes a collection of pages, either bound or unbound, either blank, printed or manuscript, and collected in a book, pamphlet, newspaper, magazine, sheet music, and like collection.

The portable unit 16 includes a support 18 for supporting the book 12 in an open condition. The support 18 includes a planar backrest 20 and a planar base 22 perpendicular to the backrest. The outer sheets of the book or covers 24 (see FIG. 2) rest on the backrest. The bottom edges 26 of the covers 24 and of the pages of the book are supported by the base 22. The support 18 is tilted relative to a generally planar, horizontal support surface 28 so that the book 12 is held in a rearwardly inclined orientation. As described below, a pair of fibrous elements 30, 31 is mounted on the base 22 so that the bottom book edges 26 rest directly on the elements 30, 31.

The support 18 is preferably constituted of a metallic material. A pair of magnets 32 is positioned on the covers 24 to hold the latter securely to the metallic backrest. Fasteners, other than magnets, could be used.

Figure 2:
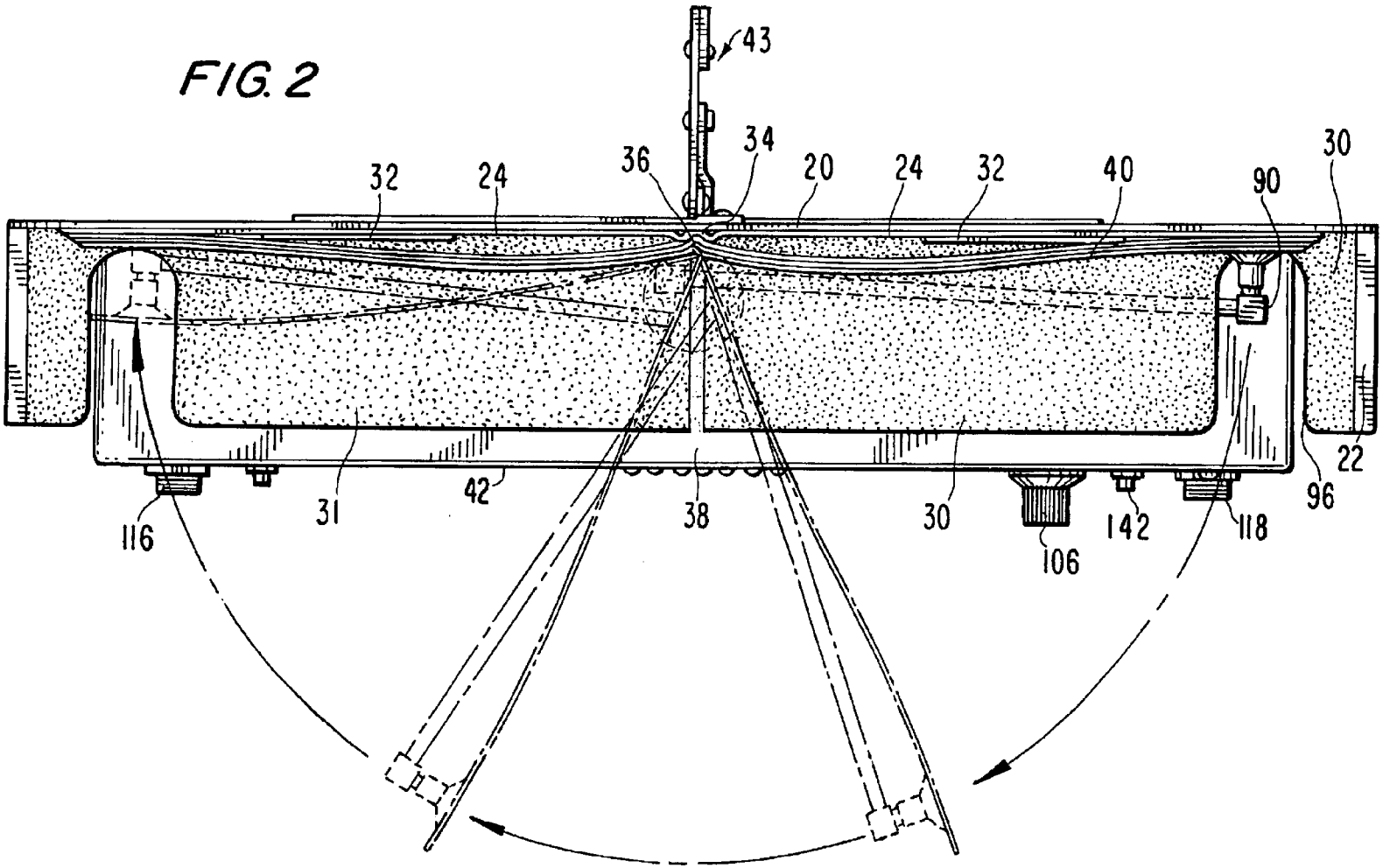
FIG. 2 is a sectional view taken on line 2—2 of FIG. 1, and depicts a page-turning motion in phantom lines.

As shown in FIG. 2, the backrest 20 may have a longitudinal channel 34 for receiving a longitudinal spine 36 of the book. The channel 34 serves as a visual indicator and as a mechanical guide for properly positioning the book on the support. Other indicators could include, for example, an arrow. Reference numeral 38 identifies the turning axis about which a selected page 40 is to be turned from its right-side position to its left-side position on the book. In an alternative embodiment, the page could be turned from the left-side position to the right-side position.

Figures 3, 9:
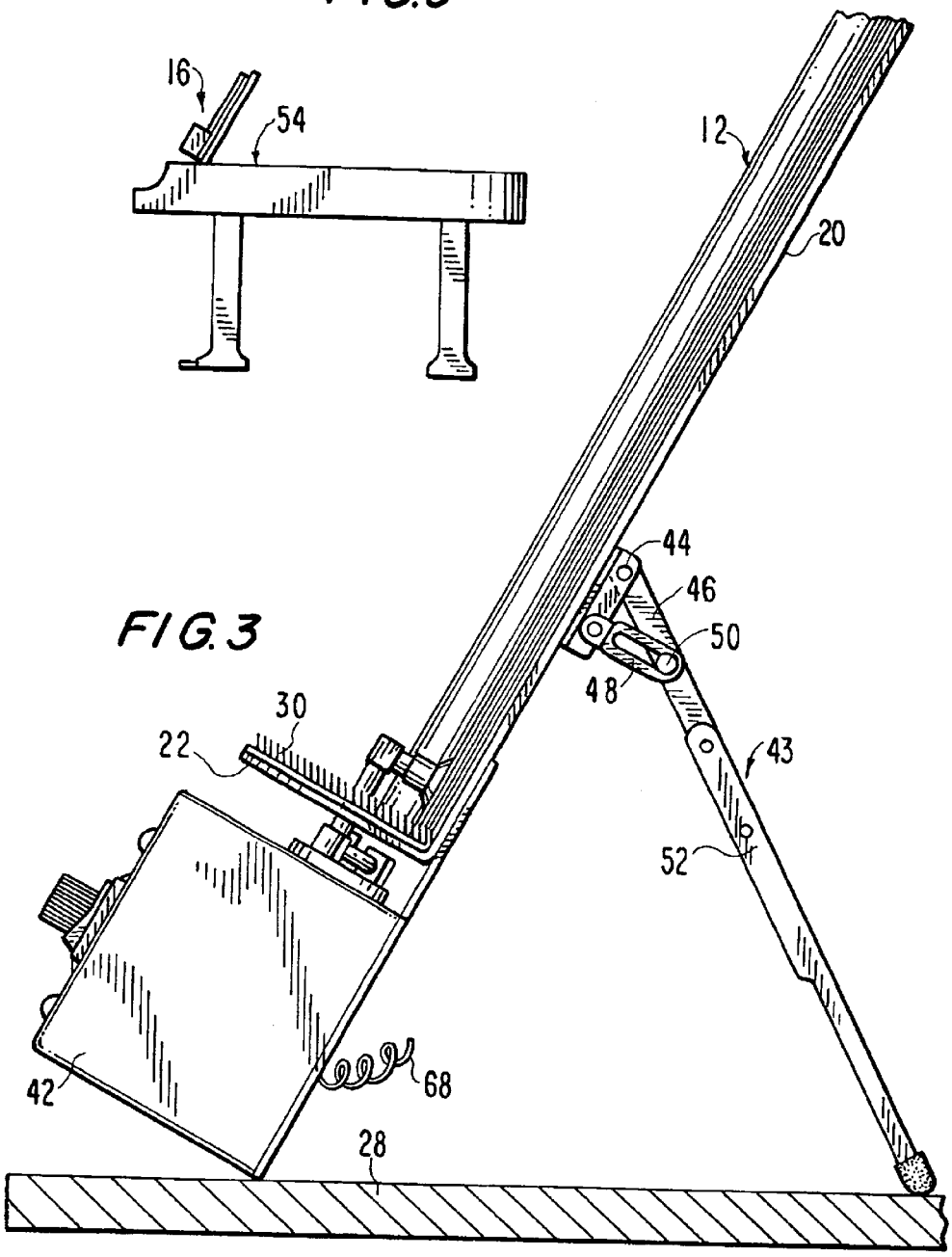
FIG. 3 is a side elevational view of a self-contained unit of the arrangement of FIG. 1.
FIG. 9 is a perspective view of the arrangement of FIG. 1 in another condition of use.

A housing 42 is connected to and below the support to form the portable unit 16. As best seen in FIG. 3, a linkage 43 is connected behind the backrest 20 to support the unit in the inclined orientation. The linkage 43 includes a bracket 44 connected to the backrest. A first link 46 is pivotably connected to an upper pivot on the bracket. A second link 48 is pivotably connected to a lower pivot on the bracket. Link 48 has a slot in which a fastening post 50 is slidably received. A leg link 52 is pivoted outwardly until it forms an extension of the link 46 at which time, the fastening post 50 is at one end of the slot and is held there by friction, thereby locking the leg link in place. The leg link can be pushed and pivoted back to an initial position directly behind the backrest in an application where the leg support is not needed. Bracket 44 can also be unscrewed and removed in the event that the backrest is required to be laid flat. The entire linkage 43 can be removed if desired. For example, as shown in FIG. 9, the portable unit 16 with its folded-up or removed leg is mounted on a rest of a piano 54, or can be mounted on a conventional floor or tabletop, music stand.

Figure 4:
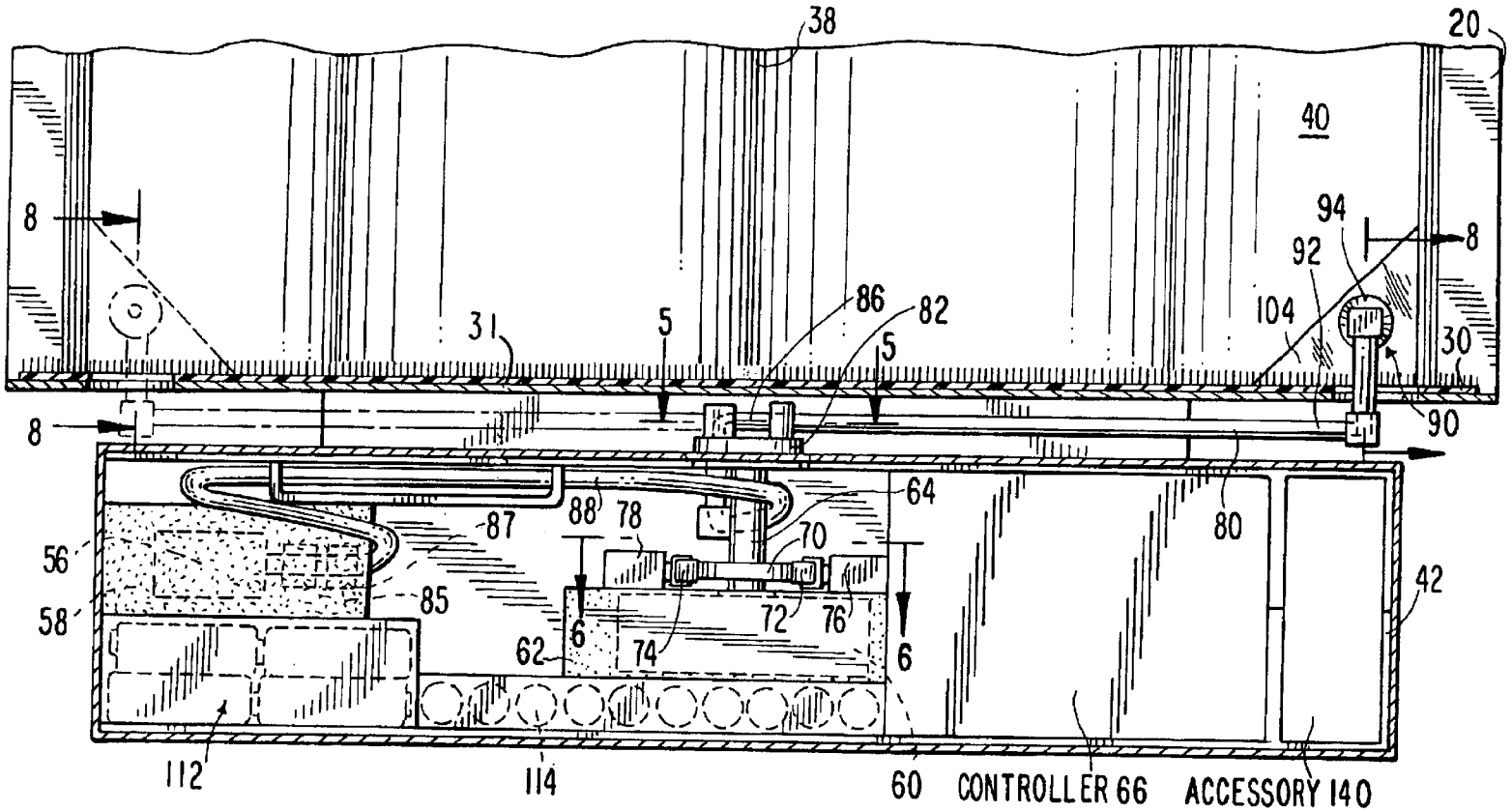
FIG. 4 is a sectional view taken on line 4—4 of FIG. 1.

As shown in FIG. 4, a suction source, including a vacuum pump 56 is mounted within the housing 42 and is encased in a foam block 58 for absorbing mechanical shock and for damping vibrations and noise. A drive, including a reversible motor 60, is also mounted within the housing 42 and is encased in another foam block 62, again for shock absorption and noise reduction. The motor 60 has a drive shaft 64 aligned with the turning axis 38 of the book. A controller 66, including a microprocessor, is electrically connected to the pump 56 and the motor 60 to control their operation, as described below. The controller 66 includes a radio frequency antenna 68 (see FIG. 3) connected to the controller 66 and in wireless, radio frequency communication with the actuator 14.

Figure 5:
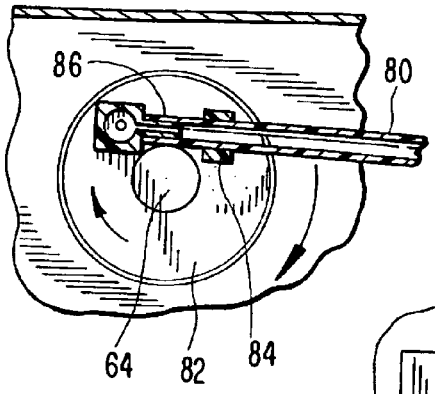
FIG. 5 is an enlarged sectional view taken on line 5—5 of FIG. 4.
Figure 6:
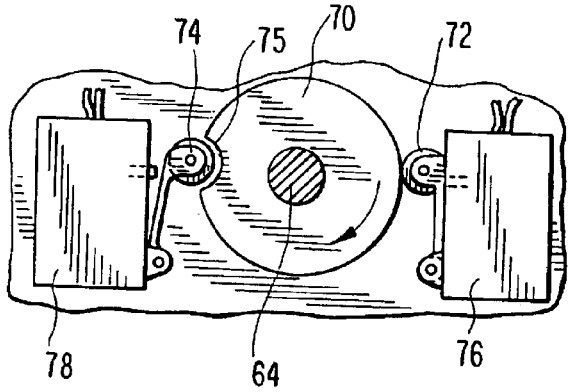
FIG. 6 is an enlarged sectional view taken on line 6—6 of FIG. 4.

An eccentric cam 70 is fixedly mounted on the shaft 64 and rides on the armatures 72, 74 of two microswitches 76, 78 which are situated at opposite sides of the shaft. A detent 75 on the cam 70 is able to receive a respective roller on each armature 72, 74. A circular disc 82 is also fixedly mounted on the shaft 64 and has an arm 80 mounted thereon for joint movement therewith. A drive clamp 84 (see FIG. 5) is fixed to the disc 82 and helps push and pull the arm 80 because, in the preferred embodiment, the arm 80 is a flexible, hollow tubing. An inner end 86 of the arm 80 is connected by additional flexible tubing 88 through a vacuum sensor 85 and a solenoid valve 87 to the pump 56. An outer end 92 of the arm is connected to a nozzle 90 having a flexible suction cup 94. A pair of cutouts 96, 98 is formed in the base 22 to permit movement of the nozzle, as described below.

In use, a reader initiates the turning of page 40, typically by stepping on a manual switch 100 on the actuator 14. Of course, the reader could also depress the switch 100 by hand, or by any other means. This action causes a radio frequency command signal to bc sent to the controller 66 via the antenna 68. Other wireless signals such as infrared or optical signals could also be used. Although not preferred, a hard-wired connection could be made between the actuator and the controller. Other actuators for controlling an electrical circuit may be used.

Upon receipt of the command signal, the controller energizes the pump 56 which begins to draw a vacuum through the tubing 88 and the arm 80 and generate a suction force at the cup 94. In the preferred embodiment, the suction force amounts to about 5 inches of mercury after about 3 seconds.

Initially, the nozzle is in a pickup position depicted in FIG. 1. The length of the arm 80 is such that the nozzle 90 is received in slot 96, overlies an outer peripheral margin 104 of the page, and is located within the boundary of the page. More particularly, the outer margin 104 is the lower, right corner of the page 40. The cup 94 contacts the corner, and the suction force ensures a tight engagement between the cup and the corner as depicted in solid lines in FIG. 7. At this time, the cam 70 depresses the armature 72 of the switch 76 so that the controller knows that the nozzle is in the pickup position.

Once a predetermined suction force has been generated and sensed by the vacuum sensor 85, the motor is energized to drive the page 40, the nozzle 90 and the arm 80 from the pickup position in one circumferential direction about the turning axis 38 along a turning path (see FIG. 2) to a release position. The flexibility of the arm 80 insures that the reader will not be injured should the reader accidentally place part of his or her body in the turning path. Energization of the motor proceeds after an adjustable time delay customized to the reader's preference and/or because a sufficient vacuum has been sensed by the vacuum sensor 85. Preferably, the movement along the turning path takes about 1–1½ seconds.

Upon reaching the release position, and traveling through an obtuse angle of about 180°, the cam 70 activates the armature 74 of the switch 78, thereby advising the controller to deenergize the pump, activate the solenoid valve 87 to dissipate the vacuum, and release the page. The nozzle 90 has entered the slot 98. The motor is halted.

Figure 8:
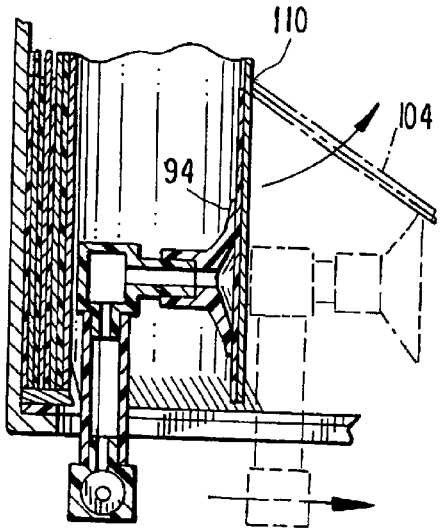
FIG. 8 is an enlarged sectional view taken on line 8—8 of FIG. 4.

Thereupon, after another customized adjustable time delay, the motor is energized to return the nozzle and the arm in an opposite circumferential direction, again for about 1–1½ seconds, about the turning axis 38. The drive clamp 84 helps drive the arm 80 back to the pickup position. The released page 40 does not participate in this return movement. Indeed, as shown in FIG. 8, the nozzle, which lies underneath the corner, pushes past the corner and at least partially bends the page at the corner. Upon reaching the about 180° position, a rear surface of the nozzle pushes any previous page to its most rearward position against the support.

An accessible rotary knob 106 is turned to adjust each time delay. Once the nozzle has reentered the slot 96, and been repositioned on the next page corner, the cam 70 activates the armature 72 and resets the controller to await the next command signal from the actuator.

The fabric element 30 has a nap whose fibers lie in a direction toward the backrest. The fabric element 31 has a nap whose fibers also lie in a direction towards the backrest. The orientation of the fibers partially restricts the movement of the page along the turning path to prevent a possible second sheet from jointly turning with the first page, as well as frictionally resisting movement of the page along the return path.

Preferably, a corner piece 108 having a pressure sensitive adhesive coating is adhered over the page corner 104. The corner piece is constituted of a nonporous, plastic film and has a triangular shape. The corner piece serves to resist the suction force from passing through the page 40 and resist one or more of the underlying pages to also be gripped by the nozzle in the pickup position.

The corner piece also has an inclined edge 110 about which the corner 104 is bent during the return movement of the nozzle. This aids in the bypassing of the page 40.

A backup battery pack 112 is also contained in the housing 42 to power the electrical components. A rechargeable battery pack 114 is used to power the electrical components. A switch 116 can be switched on to select which battery pack is to be used. A main power switch 118 can be switched on to power the controller, the pump and the motor. The pack 1114 may be recharged during operation of the arrangement by being connected to an external power supply.

Figure 10:
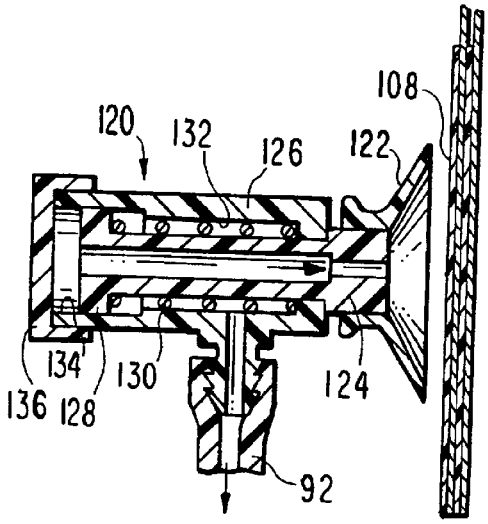
FIG. 10 is a view analogous to FIG. 7, but of a modified nozzle prior to engagement with a page.
Figure 11:
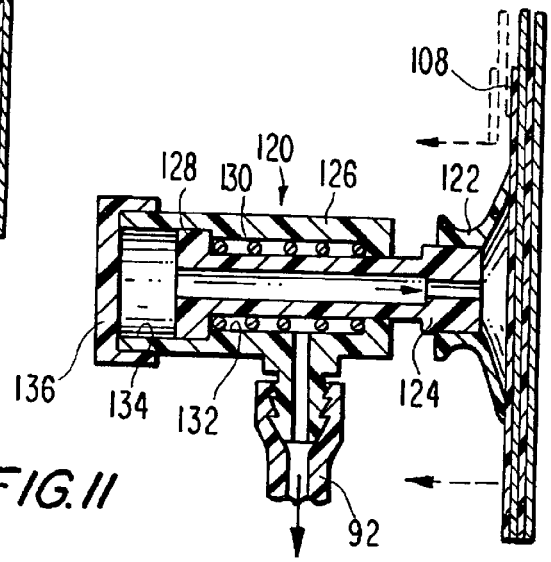
FIG. 11 is a view analogous to FIG. 10, but of the modified nozzle after engagement with the page.

FIGS. 10–11 illustrate a modified nozzle 120 which is preferred over the nozzle 90 described above. Nozzle 120 has a flexible cup 122 mounted for joint movement on a piston 124 which is received in a cylinder 126. The piston 124 has a head 128. A spring 130 is captured between the cylinder and the head. The head 128 divides the interior of the cylinder into a first chamber 132 in which the spring is contained, and a second chamber 134 bounded between the head and an end cap 136.

Figure 7:
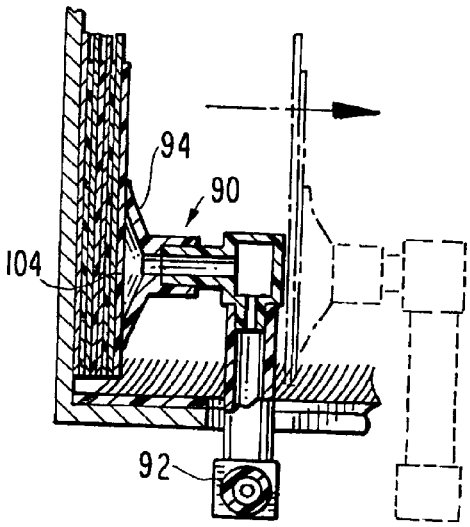
FIG. 7 is an enlarged sectional view taken on line 7—7 of FIG. 4.

In the pickup position of FIG. 7, the nozzle 90 is positioned relative to the page corner 104 so that the cup 94 touches the corner piece 108. By contrast, in the pickup position of FIG. 10, the nozzle 120 is positioned at a distance on the order of ⅛ inch away from the corner piece 108. When the suction force is initially drawn within first chamber 132, the head 128 and the cup 122 are abruptly moved in a sudden stroke toward the corner piece, and concurrently the spring 130 is compressed. This stroke provides an aggressive attack on the page, after which the page is held by the suction force (FIG. 11). The piston and the cup aggressively return to their original retracted position as a result of the reverse of the vacuum now apparent in the chamber 134 redirected as a result of the cup being blocked by the page. When the vacuum is terminated, the piston and the cup remain in their retracted position again due to the restoring force of the spring 130.

As described, the nozzle 90 or 120 enters and exits the slots 96, 98 during the page turning operation. The radial distance from the slots to the turning axis 38 is fixed, thereby making the arrangement useful for a book having pages of a certain size. If different sized pages are to be used with the same arrangement, this invention proposes the formation of a plurality of slots at different radial distances from the turning axis. A corresponding set of arms 80 of different lengths can be matched to the different slots.

An accessory 140 (see FIG. 4) actuatable by a control switch 142 (see FIG. 1), such as a metronome for signaling a given tempo and/or a tuner for generating one or more reference tones at a given frequency, may be incorporated in the housing.

It will be understood that each of the elements described above, or two or more together, also may find a useful application in other types of constructions differing from the types described above.

While the invention has been illustrated and described as embodied in a page turning arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the drive being operative for jointly moving the nozzle and the page along the turning path, and for returning the nozzle from the release position in an opposite circumferential direction about the turning axis along a return path to the pickup position, the nozzle partially bending the page at the outer peripheral region during movement along the return path;

d) an actuator operatively connected to the drive and the source, for initiating turning of the page; and e) a controller operatively connected to the source and the drive, the controller being operative for energizing the source in the pickup position and, after a first time delay, energizing the drive until the nozzle has been moved to the release position, and the controller being further operative for deenergizing the source in the release position and, after a second time delay, energizing the drive until the nozzle has been moved to the pickup position.

2. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the drive being operative for jointly moving the nozzle and the page along the turning path, and for returning the nozzle from the release position in an opposite circumferential direction about the turning axis along a return path to the pickup position, the nozzle partially bending the page at the outer peripheral region during movement along the return path;

d) an actuator operatively connected to the drive and the source, for initiating turning of the page;

e) a vacuum sensor for sensing the suction force; and f) a controller operatively connected to the source and the drive, the controller being operative for energizing the source in the pickup position and, after the vacuum sensor has sensed that the suction force has a predetermined value, energizing the drive until the nozzle has been moved to the release position.

3. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the drive being operative for jointly moving the nozzle and the page along the turning path, and for returning the nozzle from the release position in an opposite circumferential direction about the turning axis along a return path to the pickup position, the nozzle partially bending the page at the outer peripheral region during movement along the return path;

d) an actuator operatively connected to the drive and the source, for initiating turning of the page; and e) means for silencing the drive.

4. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the drive being operative for jointly moving the nozzle and the page along the turning path, and for returning the nozzle from the release position in an opposite circumferential direction about the turning axis along a return path to the pickup position, the nozzle partially bending the page at the outer peripheral region during movement along the return path;

d) an actuator operatively connected to the drive and the source, for initiating turning of the page; and e) a power unit for supplying electrical power to the arrangement, the power unit including a rechargeable battery.

5. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying a corner of the page and being located within a boundary of the page in the pickup position, the drive being operative for jointly moving the nozzle and the page along the turning path, and for returning the nozzle from the release position in an opposite circumferential direction about the turning axis along a return path to the pickup position, the nozzle partially bending the page at the corner during movement along the return path;

d) an actuator operatively connected to the drive and the source, for initiating turning of the page; and e) a corner piece on the corner and in constant engagement with the nozzle during movement along the turning path, the corner piece being a nonporous, triangular, adhesive element adhered to the corner of the page.

6. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the nozzle including a flexible cup which partially flattens against the page in the energized state, the drive being operative for jointly moving the nozzle and the page along the turning path, and for returning the nozzle from the release position in an opposite circumferential direction about the turning axis along a return path to the pickup position, the nozzle partially bending the page at the outer peripheral region during movement along the return path; and d) an actuator operatively connected to the drive and the source, for initiating turning of the page.

7. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the nozzle including a piston and a flexible cup jointly movable into engagement with the page in the energized state in the pickup position, the drive being operative for jointly moving the nozzle and the page along the turning path, and for returning the nozzle from the release position in an opposite circumferential direction about the turning axis along a return path to the pickup position, the nozzle partially bending the page at the outer peripheral region during movement along the return path; and d) an actuator operatively connected to the drive and the source, for initiating turning of the page.

8. An arrangement for turning pages of a book, comprising:

a) a support for holding the book open;

b) a suction source, including a nozzle, for generating a suction force at the nozzle in an energized state, and for discontinuing the suction force at the nozzle in a deenergized state;

c) a drive for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the nozzle lying under the outer peripheral margin of the page in the release position, the drive being operative for jointly moving the nozzle and the page along the turning path, and for returning the nozzle from the release position in an opposite circumferential direction about the turning axis along a return path to the pickup position, the drive being further operative for pushing a previously turned page toward the support during movement to the release position, the nozzle partially bending and bypassing the page at the outer peripheral region during movement along the return path; and d) an actuator operatively connected to the drive and the source, for initiating turning of the page.

9. The arrangement of claim 8, wherein the support includes a backrest against which covers of the book lay, a base on which lower edges of the pages lay, and an indicator for visually aligning a spine of the book with the turning axis.

10. The arrangement of claim 9, wherein the support includes means for fixing the book covers against the backrest.

11. The arrangement of claim 9, wherein the drive includes an arm for supporting the nozzle, and wherein the base has slots for receiving the arm during movement to the pickup and release positions.

12. The arrangement of claim 11, wherein the arm is flexible.

13. The arrangement of claim 8, and further comprising means on the support for resisting movement of the page along the return path during the movement of the nozzle along the return path.

14. The arrangement of claim 9, and at least one fibrous element on the base for engaging the lower edges of the pages, the element having fibers oriented toward the backrest.

15. The arrangement of claim 8, and further comprising a housing connected to the support and forming a portable page turning unit, and wherein the source and the drive are contained in the housing; and wherein the actuator is located remotely from the page turning unit.

16. The arrangement of claim 15, and further comprising means for supporting the page turning unit on a generally planar support surface.

17. The arrangement of claim 15, and further comprising means for supporting the page turning unit on a floor stand.

18. The arrangement of claim 8, and a controller operatively connected to the source and the drive, and wherein the actuator is in wireless communication with the controller.

19. The arrangement of claim 8, wherein the suction source includes a vacuum pump in fluid flow communication with the nozzle along a swing arm extending between the turning axis and the nozzle.

20. The arrangement of claim 8, wherein the drive includes a reversible motor.

21. The arrangement of claim 8, and a controller operatively connected to the source and the drive, the controller being operative for energizing the source in the pickup position and, after a first time delay, energizing the drive until the nozzle has been moved to the release position; and the controller being further operative for deenergizing the source in the release position and, after a second time delay, energizing the drive until the nozzle has been moved to the pickup position.

22. The arrangement of claim 8, and means for adjusting each time delay.

23. The arrangement of claim 8, and a vacuum sensor for sensing the suction force, and a controller operatively connected to the source and the drive, the controller being operative for energizing the source in the pickup position and, after the vacuum sensor has sensed that the suction force has a predetermined value, energizing the drive until the nozzle has been moved to the release position.

24. The arrangement of claim 23, and a valve for discharging the suction force, the controller being operative for deenergizing the source in the release position and, after the valve has discharged the suction force, energizing the drive until the nozzle has been moved to the pickup position.

25. The arrangement of claim 8, and means for silencing the drive.

26. The arrangement of claim 8, and a power unit for supplying electrical power to the arrangement, the power unit including a rechargeable battery.

27. The arrangement of claim 8, and further comprising means on the support for resisting more than one page being moved along the turning path.

28. The arrangement of claim 8, wherein the outer peripheral margin of the page is a corner, and further comprising a corner piece on the corner and in constant engagement with the nozzle during movement along the turning path.

29. The arrangement of claim 28, wherein the corner piece is a nonporous, triangular, adhesive element adhered to the corner of the page.

30. The arrangement of claim 28, wherein the corner piece has an inclined edge about which the corner is bent during movement of the nozzle along the return path.

31. The arrangement of claim 8, wherein the nozzle includes a flexible cup which partially flattens against the page in the energized state.

32. The arrangement of claim 8, wherein the nozzle includes a piston and a flexible cup jointly movable into engagement with the page in the energized state in the pickup position.

33. An arrangement for turning pages of a book, comprising:

a) a support for holding the book open;

b) a housing connected to the support and forming a portable page turning unit therewith;

c) a suction source, including a vacuum pump in the housing and a nozzle, for generating a suction force at the nozzle in an energized state, and for discontinuing the suction force at the nozzle in a denenergized state;

d) a drive including a reversible motor in the housing, for moving the nozzle from a pickup position in which the nozzle engages a page to be turned in the energized state, in one circumferential direction about a turning axis along a turning path, to a release position in which the nozzle releases the page in the deenergized state, the nozzle overlying an outer peripheral margin of the page and being located within a boundary of the page in the pickup position, the nozzle lying under the outer peripheral margin of the page in the release position, the drive being operative for jointly moving the nozzle and the page along the turning path, and for returning the nozzle from the release position in an opposite circumferential direction about the turning axis along a return path to the pickup position, the drive being further operative for pushing a previously turned page toward the support during movement to the release position, the nozzle partially bending and bypassing the page at the outer peripheral region during movement along the return path; and e) an actuator operatively connected to the drive and the source, for initiating turning of the page.

34. The arrangement of claim 33, wherein the nozzle has a rear surface for pushing a previously turned page toward the support during movement to the release position.

35. The arrangement of claim 33, and a musical accessory for generating sounds located in the housing.

* * * * *